US005119599A

United States Patent [19]

Klipper et al.

[11] Patent Number: 5,119,599

[45] Date of Patent: Jun. 9, 1992

[54] DIAMOND DRESSING UNIT FOR GRINDING WHEELS

[75] Inventors: Joseph Klipper, New York, N.Y.; Jack Graham, Alfred, Me.; Samuel Brady, Bloomfield Hills, Mich.

[73] Assignee: Clipper Diamond Tool Co., Inc., New York, N.Y.

[21] Appl. No.: 557,925

[22] Filed: Jul. 25, 1990

Related U.S. Application Data

[63] Continuation-in-part of Ser. No. 532,910, Jun. 4, 1990, abandoned.

[51] Int. Cl.[5] ..... B24B 49/00

[52] U.S. Cl. ..... 51/165.77; 51/165.9; 51/325; 125/11.01; 125/11.03; 125/11.18

[58] Field of Search ..... 125/11.01, 11.03, 11.18, 125/11.2; 51/5 D, 34 R-34 J, 165.77, 165.8, 165.85, 165.9, 325, 326, 327

[56] References Cited

U.S. PATENT DOCUMENTS 3,885,353 5/1975 Ota et al. ..... 51/165.8

4,606,150 8/1986 Grimm ..... 51/34 D

*Primary Examiner*—M. Rachuba

*Attorney, Agent, or Firm*—Darby and Darby

[57] ABSTRACT

A dressing unit for advancing and retracting a spindle, having a diamond roll rotatably mounted thereon, wherein advancement of the spindle brings the diamond roll into contact with a grinding wheel for dressing the grinding wheel. The dressing unit comprises an outer ram mounted within a housing, an inner ram telescopically disposed within the outer ram, means for advancing and retracting the outer ram to a positive stop, and means independent of the advancing and retracting means for incrementally moving the inner ram from an inner position to an extended position. The inner ram is connected to the spindle to advance the spindle to thereby bring the mounted diamond wheel into contact with the grinding wheel.

29 Claims, 6 Drawing Sheets

Fig. 6
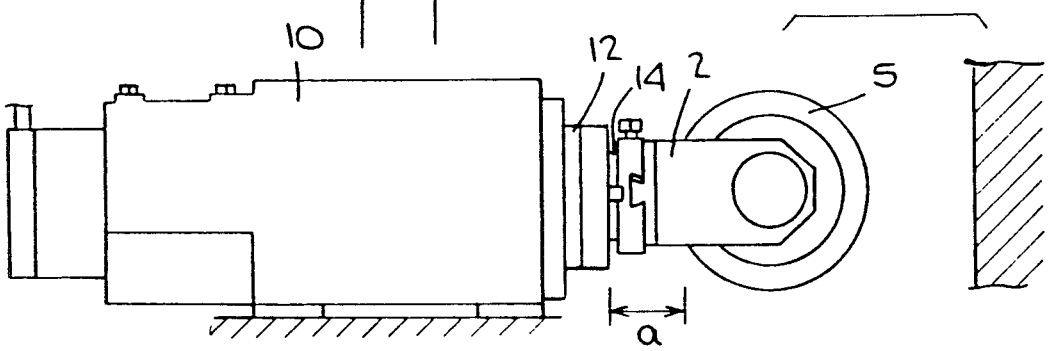
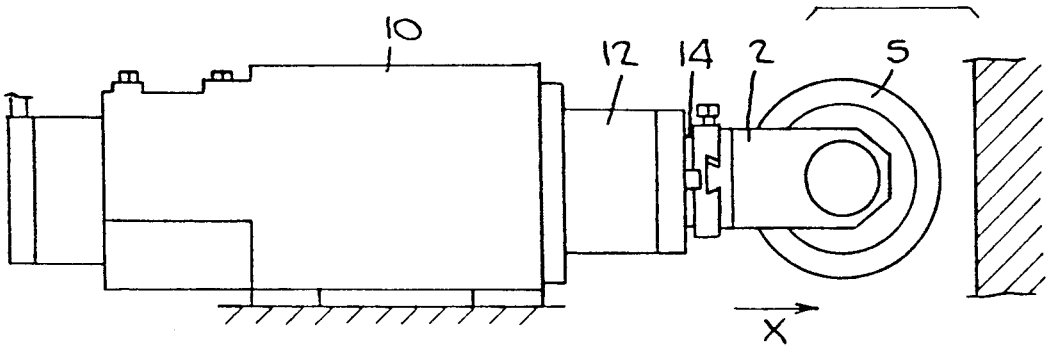
Fig. 7
Fig. 9
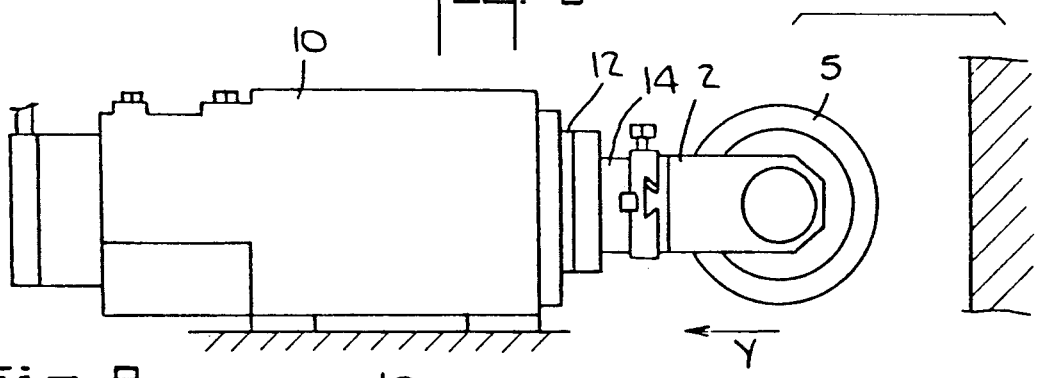
Fig. 8
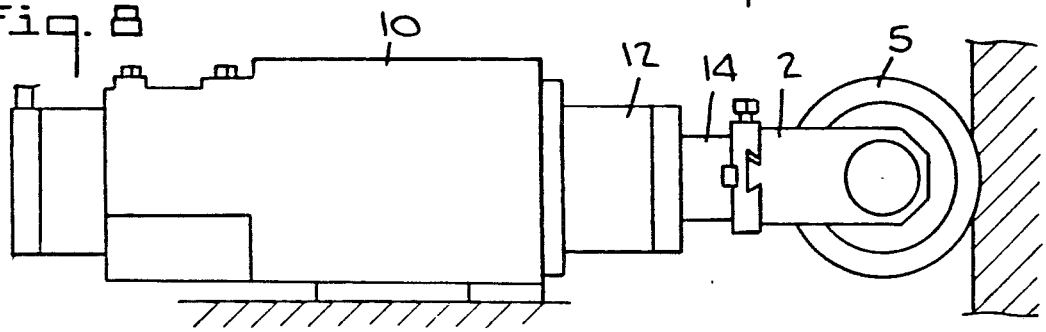

DIAMOND DRESSING UNIT FOR GRINDING WHEELS

BACKGROUND OF THE INVENTION

This is a continuation-in-part of application Ser. No. 532,910, filed Jun. 4, 1990 now abandoned.

1. Field of the Invention

This invention relates to a diamond dressing unit for dressing grinding wheels and more particularly to a dressing unit having an incremental infeed unit for advancing a diamond roll in relation to a grinding wheel, particularly useful with internal grinders.

2. Description of the Related Art

In the automated production of various parts for machinery for automotive, bearing, aircraft or other industries, precision tolerances and high finishes are required. Such precision grinding has been achieved utilizing diamonds to form and maintain the contours of a grinding wheel which shapes material into the desired part. The importance of precision in grinding cannot be understated since many of the specifications require accuracy to one ten-thousandth or even 2.5 millionths of an inch.

At first, a single point diamond tool was used which was mounted on a cam or a pantograph device and brought into contact with a grinding wheel. The diamond shaped the grinding wheel which in turn shaped the material to the required specifications for forming the machine part.

The single point diamond, although able to shape the grinding wheel to specific precision tolerances, was inefficient because it was time consuming, it increased manufacturing costs and slowed down production and if the diamond chipped, scrap pieces were produced.

A significant improvement in diamond dressing technology came with the development of a diamond formed roll. These diamond rolls were rotatably mounted on a shaft (spindle), and the spindle wa connected to the dressing device. The dressing device advanced the spindle to thereby advance the mounted diamond roll into the grinding wheel for dressing and then retracted the spindle to remove the diamond roll from contact with the grinding wheel after dressing. The diamond roll was brought into contact with the grinding wheel to simultaneously shape the whole grinding wheel. This overcame the disadvantages of the single point diamond by significantly reducing the dressing time.

In one prior art form of the dressing device, the advancing/retracting mechanism was hinged. However, the hinge wore out after frequent use, thus requiring frequent replacement. In another form, the dressing unit was mounted on a slide. However, the slide could not be sufficiently covered to prevent debris from getting inside, therefore causing damage to the parts and adversely affecting the precision dressing.

A beneficial advance came with the development of a sealed cylindrical ram. This apparatus is shown in the brochure No. R5-741 entitled "Clipper Rotodress Diamond Precision Rotodress System", published by Clipper Diamond Tool Co., Inc. This ram was connected to the spindle to advance the spindle and diamond roll into contact with the grinding wheel for dressing and then to retract it after dressing. The ram was heavy, rigid, and provided for maximum vibration dampening. It also required less maintenance compared to the aforementioned hinge and slide mechanisms because the ram, being round, formed a more effective seal which prevented grindings from getting onto the bearing surfaces.

This ram dressing device could be mounted on plain, angle, crankshaft, vertical, centerless or other grinding machines to provide means in situ for correcting grinding wheels by dressing them periodically as they wore down in use. The ram provided for incremental infeed of the diamond roll into the grinding wheel. The incremental infeed ram was controlled with either a stepping motor, a hydraulic indexer, or servomotor.

Although this ram was an improvement over the then existing dressing units, it suffered from deficiencies of its own. It was too large to be used with many internal grinders in which there is a limited amount of space. These internal grinders require the spindle on which the diamond roll is mounted to be able to be rapidly advanced for dressing to differing positions (depending upon the position of the grinding wheel on its cross slide) and to be rapidly retracted to move out of the way of the grinding wheel to permit its usual use. However, retraction of this device could not be accomplished quickly enough with a stepping motor, hydraulic indexer or servomotor and still stay within the space limitations.

The need therefore exists for a dressing unit having a round ram to obtain the advantages of rigidity, minimum vibration and proper sealing, but which could fit within units such as those utilizing internal grinders and allow quick advance to differing positions and quick retraction to a positive stop after dressing.

SUMMARY OF THE INVENTION

The present invention overcomes the problems and deficiencies of the prior art by providing a dressing unit for advancing and retracting a spindle-mounted diamond roll into position for contact with a grinding wheel, for dressing the grinding wheel, where the dressing unit comprises an inner ram telescopically received within an outer ram, with the inner ram holding the spindle and diamond roll. The outer ram is advanced and retracted to positive stops while the inner ram has independently (preferably incremental) moving means for moving it to different extended positions. Movement of the inner ram advances the spindle to bring the diamond roll into a position suitable for contact with the grinding wheel. Consequently, both variable movement of the diamond roll into a position for contact with the grinding wheel for dressing, and rapid movement of the diamond roll out of contact with the grinding wheel after dressing, are advantageously obtained. The dressing unit of the present invention thereby advantageously results in a smaller machine for the spacing required for the grinding machine, and also provides additional spacing from the grinding wheel for a desired range of movement of the diamond roll. It also provides rapid advance and retraction of the diamond roll for speedier repetitive dressing for grinding operations.

BRIEF DESCRIPTION OF THE DRAWINGS

The objects, features, and advantages of the present invention will be more completely disclosed with reference to the following detailed description of presently preferred embodiments of the present invention, taken with the attached drawings, in which:

FIG. 6 shows a side view of the dressing unit and the attached spindle and diamond roll in the fully retracted position;

FIG. 7 shows a side view of the dressing unit and the attached spindle and diamond roll wherein the outer ram of the dressing unit is in its extended position;

FIG. 8 shows a side view of the dressing unit and the attached spindle and diamond roll wherein the outer ram of the dressing unit is in its extended position and the inner ram is in a forward dressing position to bring the diamond roll into contact with the grinding wheel; and FIG. 9 shows a side view of the dressing unit and its attached spindle and diamond roll wherein the outer ram of the dressing unit is in its retracted position and the inner ram remains in its forward position.

DETAILED DESCRIPTION OF THE PREFERRED EMBODIMENTS

Figure 1:
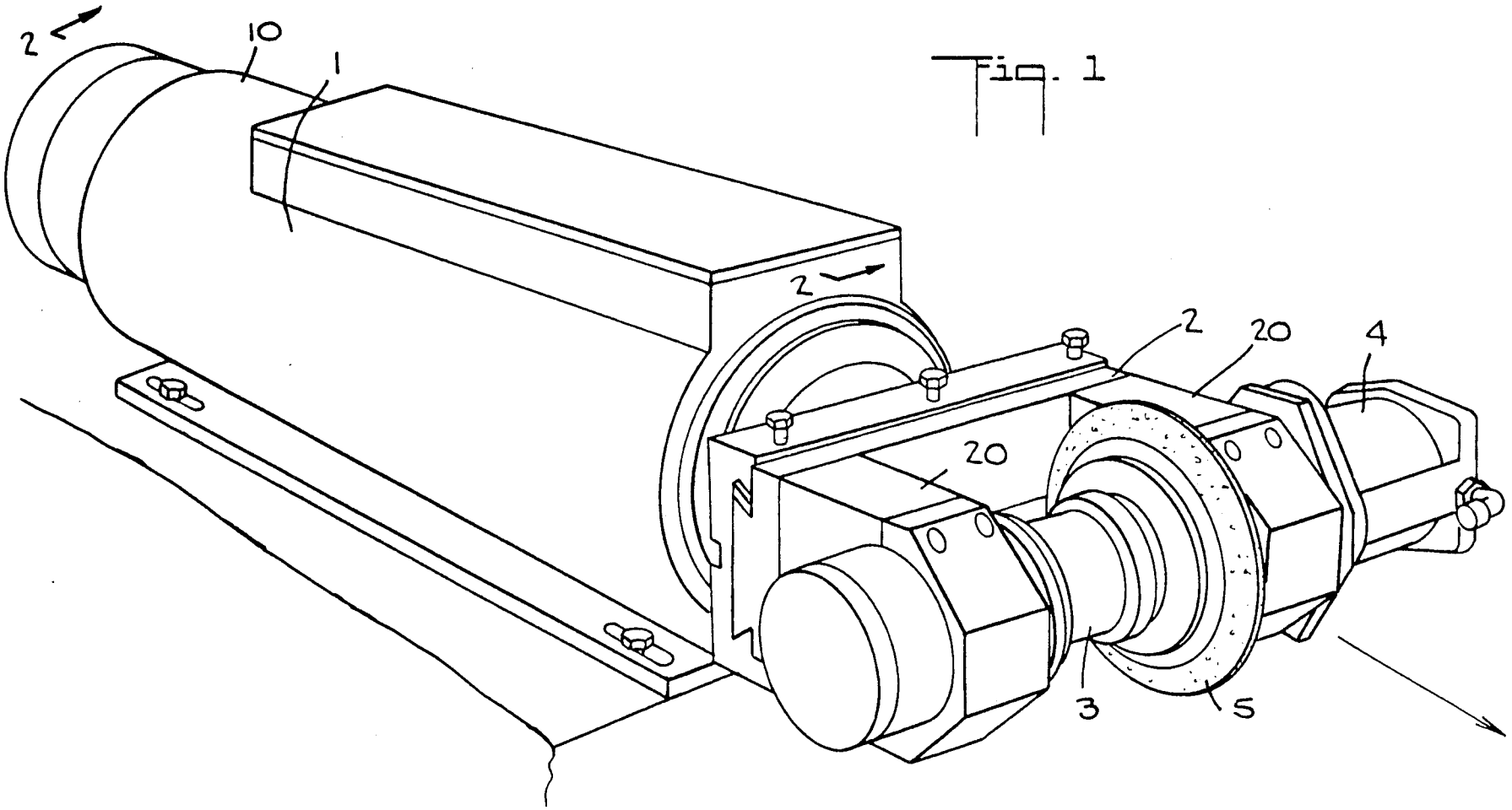
FIG. 1 is a perspective view showing the spindle and mounted diamond roll attached to the dressing unit of the present invention.

Referring now to the drawings, wherein like reference numerals represent identical or corresponding parts throughout the several views, FIG. 1 illustrates a dresser unit 1 of the present invention mounted to a spindle 3 by a yoke 2. A diamond roll 5 is rotatably mounted on the spindle 3 which is powered by a spindle drive 4. The dressing unit 1 is designed to advance spindle 3 and thus place diamond roll 5 in position for contact with a rotating grinding wheel (not shown) in order to dress (form and maintain the contours of) the grinding wheel. The dressed grinding wheel may then be used to shape material to form a part to precision tolerances. The dressing unit 1 is preferably fixedly mounted to a grinding machine to allow periodic repetitive dressing of the grinding wheel.

The sequence of the dress cycle for a grinding wheel can be considered as involving the following steps:

1. rotation of spindle 3 and diamond roll 5 is started by spindle drive 4 and coolant is applied to the diamond roll 5;
2. after a programmed interval, preferably approximately 2 seconds, the dresser unit 1 rapidly advances (preferably in approximately one second) the spindle 3 and diamond roll 5 to the dress position—in position for contact with the rotating grinding wheel;
3. the diamond roll 5 dwells for a programmed period of time in the dress position, preferably approximately 2-6 seconds;
4. after dressing, the spindle 3 and diamond roll 5 are rapidly retracted by dresser unit 1 and the coolant flow and rotation of the diamond roll 5 stop.

The dressed grinding wheel shapes materials, such as metal, to manufacture desired parts to specifications. The above sequence of steps constitutes a conventional dressing cycle.

The diamond roll 5, which is conventional, advantageously allows dressing of various portions of the grinding wheel at one time, a significant improvement over the single point diamond tool which could only dress a single portion at a time. The diamond roll 5 can be of any type, such as handset where the stones are set by hand in a predetermined pattern, random set which has a single layer of diamonds uniformly distributed in a random pattern, or impregnated wherein diamonds are uniformly distributed in a random pattern to various depths. This is described in the Clipper Diamond Tool brochure, referred to above in the Background of the Invention section, and is herein incorporated by reference. The type of diamond roll used and the arrangement of the diamonds depends on the wheel grade, the material to be ground, the finish required and the various patterns to be used.

The diameter and length of the spindle (shaft) 3 will depend on the width and diameter of the diamond roll 5 used. The spindle drive 4 can be powered by any means, such as air, hydraulic, electric motor or a belt drive, to rapidly rotate the spindle 3 to cause corresponding rapid rotation of the mounted diamond roll 5.

The yoke 2 can be of any type to connect the dresser unit 1 to the spindle 3. In the embodiment shown in FIG. 1, yoke 2 comprises a pair of arms 20 having an opening to receive spindle 3. The diamond roll 5 is shown mounted between the arms 20.

Thus far, the conventional dressing cycle and a conventional spindle, yoke and diamond wheel have been described. The present invention provides a unique apparatus and method for incrementally advancing and retracting the spindle 3 for use in dressing grinding wheels. That is, the dressing unit 1 of the present invention is designed to incrementally advance spindle 3 to thereby bring diamond roll 5 into a position for contact with the grinding wheel and to rapidly retract the spindle 3 and mounted diamond roll 5 from the grinding wheel after dressing. The dressing unit 1 is advantageously of sufficiently small length to be able to be used for internal grinding machines. The sufficient space allows adequate retraction after dressing to provide clearance from the grinding wheel and to allow replacement of the internal grinding wheels. Obviously the dresser unit 1 can be used with external grinding machines as well.

Figure 2:
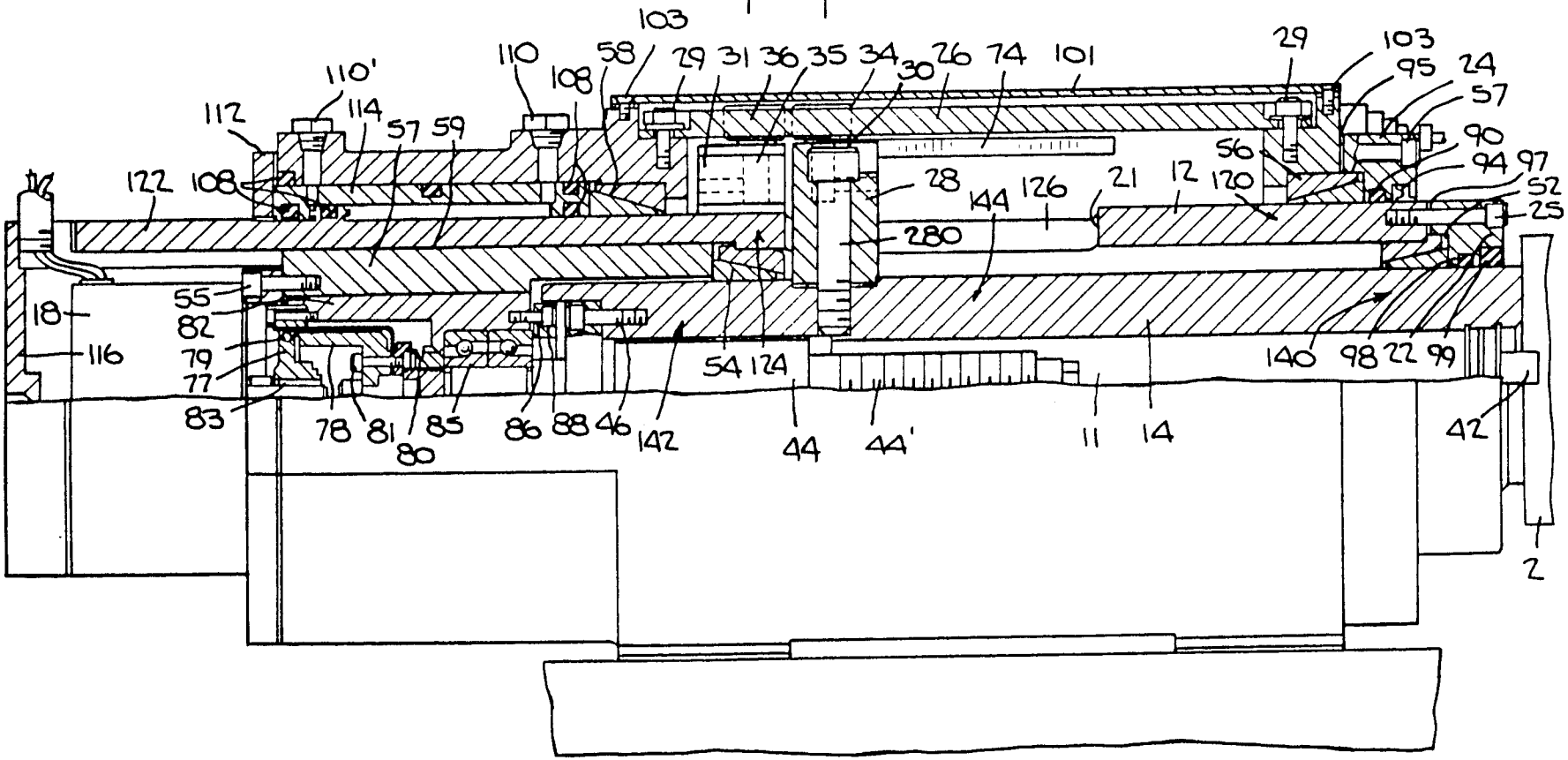
FIG. 2 shows a longitudinal section view, taken along lines 2—2 of FIG. 1 illustrating the dressing unit in its fully retracted position.

Referring to FIGS. 1 and 2, the dresser unit 1 comprises a housing 10, an outer ram 12, and an inner ram 14. The outer ram 12 is preferably hollow and cylindrically shaped, and is rapidly movable between fixed retracted and extended positions. Movement of outer ram 12 is limited by forward and rearward positive stops, which are described below, to ensure accuracy. Inner ram 14 is cylindrically shaped and is telescopically disposed within outer ram 12. Inner ram 14 is incrementally advanced, as by a stepping motor or servomotor or hydraulic means to various forward positions. The inner ram 14 is connected to spindle 3 by yoke 2 to advance the spindle-mounted diamond roll 5 into position for contact with the grinding wheel.

Before turning to the details of the mounting of the outer and inner rams 12, 14 within housing 10, the operation of the rams will first be summarized. With reference to FIGS. 6-9, one method of operation useful with external grinding wheels generally involves the following steps:

a. outer ram 12 is moved forward, carrying inner ram 14, from its retracted position (FIG. 6) to an extended position (FIG. 7);

b. inner ram 14 is advanced (as by manual control) towards the grinding wheel to a first forward dressing position where the spindle-mounted diamond roll 5 may be brought into contact with the grinding wheel (FIG. 8);

c. inner ram 14 is advanced an additional step or steps (operator-selected or automatically programmed) forward for dressing;

d. on completion of dressing outer ram 12 is moved rearward to its original retracted position (FIG. 9), carrying with it inner ram 14;

e. for the next dressing operation outer ram 12 is moved forward to its advance position, carrying inner ram 14, to its extended position (FIG. 9);

f. inner ram 14 is advanced towards the grinding wheel by another increment or step to a second forward dressing position;

g. steps (d), (e) and (f) are repeated as needed to keep the grinding wheel in proper condition after each series of grinding operations;

h. at the conclusion of grinding operations outer ram 12 is moved rearwardly to its original retracted position and inner ram 14 is moved inwardly to its innermost position, affording space to permit changing grinding wheels when needed.

Alternately, the inner ram 14 can be incrementally advanced after step (d) while the outer ram 12 is in its retracted position so that advancement of outer ram 12 to its extended position moves inner ram 14 into the dressing position for dressing the grinding wheel.

This incremental feed thereby maintains the shape of the grinding wheel. The incremental feed step of the inner ram 12 can be of any distance including fractions of an inch as small as a few millionths of an inch. The inner ram 12 can also be advantageously rapidly retracted a sufficient distance away from the grinding wheel after dressing by retraction of outer ram 12 to prevent interference with the grinding wheel. Thus, the incremental feed unit may slowly move the inner ram 12 from its innermost position as shown in FIG. 6 to its outer dressing position shown in FIG. 8. As used herein, the term "forward", "outward" or "extended" denotes movement away from the center of the housing towards the grinding wheel and "rearward", "inner" or "retracted" denotes movement in the opposite direction (toward the center of housing 10).

Turning now to the outer ram 12, and more particularly to FIG. 2, outer ram 12 has a front end portion 120, a rear end portion 122 and a central portion 124. Central portion 124 includes an elongated slot 126 which accommodates movement of the inner ram 14 in a manner described below.

Outer ram 12 is mounted within housing 10 by preloaded front tapered upper bearings 56 and rear upper tapered bearings 58. Front upper bearings 56 are under tension due to the rearward axially directed tension force exerted by end cap 24 by mounted end screw 57 which extends through an axial bore of end cap 24 and front end 120 of outer ram 12. Rear upper bearings 58 are maintained under tension by the forward axially directed force of cylinder 114.

In one embodiment the internal diameter of outer ram 12 is illustratively 5 inches and the outer diameter is illustratively 5½ inches. The length of outer ram 12, in one embodiment is 19 inches. Obviously, rams of different dimensions could be utilized.

Figure 3:
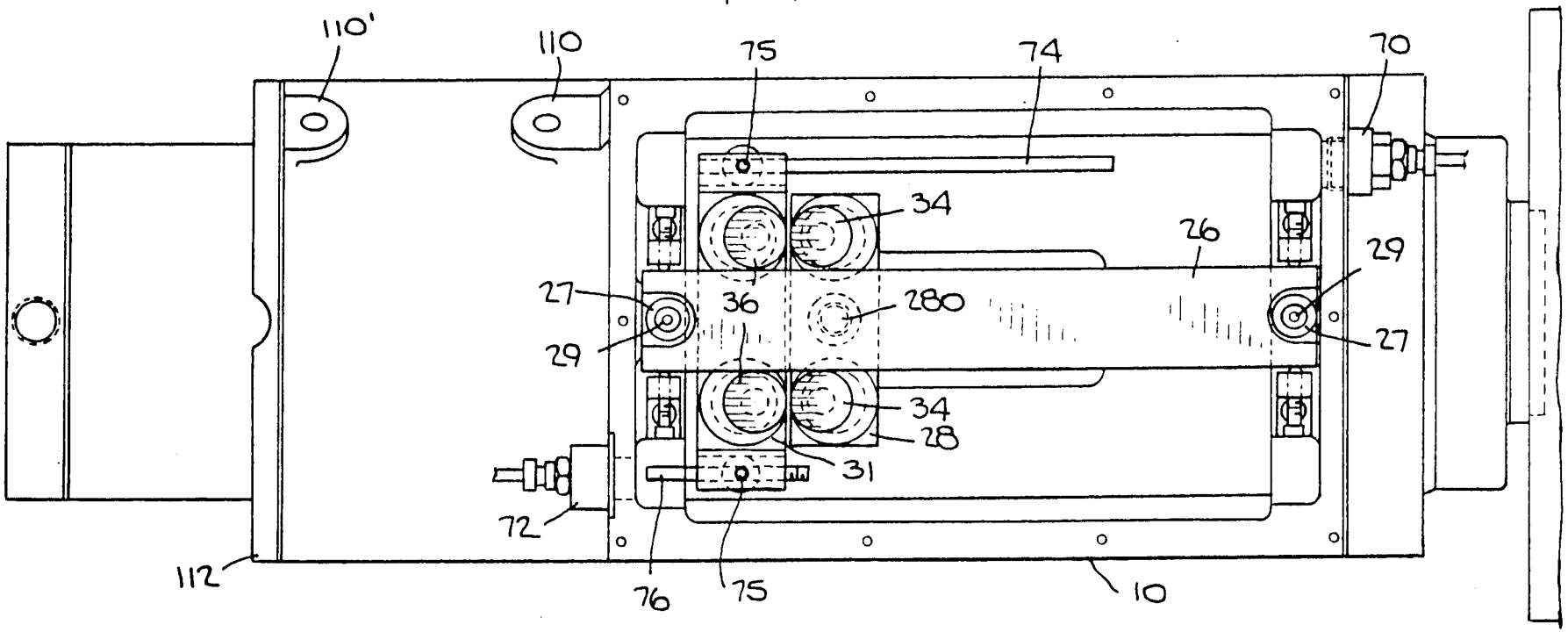
FIG. 3 shows a top view of the dressing unit of the present invention.

A transversely extending block 31 is mounted to central portion 124 of outer ram 12 by a pair of screws (FIGS. 2 and 3). A pair of eccentrically mounted, independently movable, steel rollers 36 are secured to block 31 by bolts 35. The rollers 36 are slidably mounted within a longitudinally extending track 26. The steel rollers 36 restrict rotational and radial movement of outer ram 12, thereby preventing vibratory movement and allowing only axial movement of outer ram 12. Track 26 is disposed above outer ram 12 and is secured to the housing 10, in parallel alignment with the outer and inner rams 12, 14, by a screw 29 and associated washer 27 disposed at opposite ends.

With continued reference to FIGS. 2 and 3, a linearly adjustable elongated actuating rod 74 and short actuating rod 76 are secured to opposing sides of rear block 31 by pins 75, and are aligned parallel to and below track 26. Actuating rod 74 is adapted to advance into contact with a front switch 70 and actuating rod 76 is adapted to come into contact with a rear switch 72, functioning as forward and rearward positive stops, respectively, to restrict outer ram 12 to move between two fixed positions.

Turning now to inner ram 14 which is telescopically disposed within outer ram 12 but spaced apart from the internal walls thereof, and more particularly to FIG. 2, inner ram 14 includes a rear end portion 142, a center portion 144 and a front end portion 140 which is connected by screws 42 to a key which in turn is attached to yoke 2.

A central block 28, preferably cylindrical in configuration, is mounted on an external surface of the central portion 124 of inner ram 14. Central block 28 is perpendicularly mounted on the inner ram 14 by a bolt 280 which extends through a bore in central block 28 and through an opening in central portion 144 of inner ram 12. Central block 28 is configured and dimensioned to be slidably received within slot 126 of outer ram 12 and forward and rearward movements of central block 28 is restricted by the terminal edges (non-slotted surface, e.g. reference numeral 21) of the outer ram 12. The movement of central block 28 along slot 126 as inner ram 12 moves can be seen by comparing FIGS. 2 and 5. In FIG. 2, which shows both the outer ram 12 and inner ram 14 in the inner position, central block 28 is positioned in the rearmost edge of slot 126. In FIG. 5, not only is the outer ram 12 in its extended position, but inner ram 14 is in one of its forward positions and central block 28 is positioned in a central region of slot 126. For clarity, not all of the parts shown and labelled in FIG. 2 are shown or labelled in FIG. 5 (and in FIG. 4), since the parts in these figures are identical; only the positioning of several of the parts differs.

A pair of front rollers 34, mounted by bolts 30 to central block 28 on opposing sides of bolt 280, slide within track 26 and restrict rotational movement of inner ram 14.

Inner ram 14 is mounted within housing 10 by preloaded front tapered lower bearings 52 and rear tapered lower bearings 54. Front lower bearings 52 are tensioned by the axially directed force of a lower end cap 22 of housing 10 which is pressed axially inwardly (towards the center of the housing 10) by an end screw 25 retained within outer ram 12. A rod-like member 57, disposed within the rear portion of housing 10 and preferably separated from the rear portion 120 of outer ram 12 by a longitudinal spacer element 59, presses against rear lower bearings 54 by the tightening force of end screw 55 inserted through a bore in member 57. End screw 55 holds the drive elements for the inner ram 14 as discussed below.

The outer diameter of the inner ram 14 is obviously less than the internal diameter of outer ram 12 since it is fitted therein, and in a preferred embodiment, the internal diameter of inner ram 14 may be illustratively 3 inches and the outer diameter may be 3½ inches. The length of inner ram 14 is illustratively 14 inches. Of course, an inner ram of a different diameter or length can be utilized, provided the diameter is sufficiently less than the outer ram's diameter to effectively function as described herein.

Disposed in the rear portion of the housing 10 within cylindrical tubular support 82 is a harmonic drive 77 which as its well known, functions as a gear reduction unit to reduce rotation of the ball screw. In a preferred embodiment, a 100 to 1 harmonic drive is utilized. A spacer 78 is connected to harmonic drive 77 by screw 79 and to coupling 80 by bolt 81. Key 83 connects harmonic drive 77 to the shaft of motor 18 so that the inner member of the harmonic drive 77 turns in response to rotation of the motor shaft. Ball bearings 85 are mounted within tubular support 82 and screw 86 secures tubular support 82 to a retainer 88 and thus to inner ram 14.

Disposed within inner ram 12 in space 11 is a nut 44 and ball screw 36. Nut 44 is held to the inner ram by screw 46 extending through a nut flange which is held against the face of the counter bore in inner ram 14. The ball screw 36 rotates but is prevented from moving axially, and its rotation causes the nut 44 to move axially to thereby move inner ram 14 axially.

Referring now to cylindrical housing 10 and with continued reference to FIG. 2, a cover 101 is disposed over the rectangular top portion and secured thereto by screws 103. Cover 101 is preferably removable to allow access to the internal parts of the housing 10. Upper end cap 24, as discussed above, is mounted to a front portion of the housing 10 and includes a wiper 94 and a seal 90 which prevents dirt or other particles from penetrating to front upper bearings 56 and other internal parts of the dressing unit which would adversely affect operation. Similarly, lower end cap 22 includes wiper 99 and seal 98 which protects front lower bearings 52 from foreign particles. Shim set 95 fills the gap between housing 10 and upper end cap 24 and shim set 97 fills the gap between lower end cap 24 and the front end of outer ram 12.

At the rear end of the housing 10 are ports 110 and 120 (see FIGS. 2 and 3), to receive oil for the hydraulic cylinder to provide bi-directional motion (forward and backward) of outer ram 12. A rear retaining plate 112 projects inside of housing 10 to bear against cylinder 114. The additional seals, designated by numerals 108, disposed adjacent the bottom portion of ports 110 and 120 and adjacent hydraulic cylinder 114 are designed to prevent leakage onto the outer ram 12, rear upper bearings 58, and other internal parts.

A motor 18, preferably a stepping motor, is disposed within a rear portion of housing 10. The stepping motor is preset with the extent of the rotation of its shaft controlled by a manual or an automatic switch to provide incremental advance of the inner ram for any desired steps, illustratively selectably by an operator from 0.01 to 5.0 thousandths of an inch. The stepping motor provides pressure through inner ram 14 on the grinding wheel during step (c) described above. Alternatively the inner ram may be stepped while the outer ram is retracted, so that such pressure is provided by the hydraulic drive for the outer ram. End screw 55 holds a flange of the stepping motor against retaining plate 112.

The rear wall of housing 10 is designated by reference numeral 116. The length of housing 10, from the rear wall 116 to the front surface of inner ram 12 in its inner position is preferably 22 inches.

A front switch 70 (FIGS. 2 and 3), mentioned above, is mounted to a front portion of housing 10 and is actuated by forward, longitudinal movement of elongated actuating rod 74. Similarly, rear switch 72, mounted to rear portion of housing 10 at the diagonally opposed corner from front switch 70, is actuated by movement of short actuating rod 74. Thus, actuating rods 74, 76 and switches 70, 72 function to provide positive stops to ensure that the retracted and extended positions of the outer ram 12 remain constant for each movement of the outer ram 12. That is, the positive stops ensure accuracy as the outer ram 12 will occupy the identical extended position each time it is thrust forwardly and will occupy the identical retracted position each time it is thrust rearwardly. Any types of switches can be utilized. Obviously, other types of positive stops could also be utilized, such as mechanical stops which physically contact the outer ram 12 to maintain limited movement to ensure accuracy (i.e. distance moved remains constant).

Figure 4:
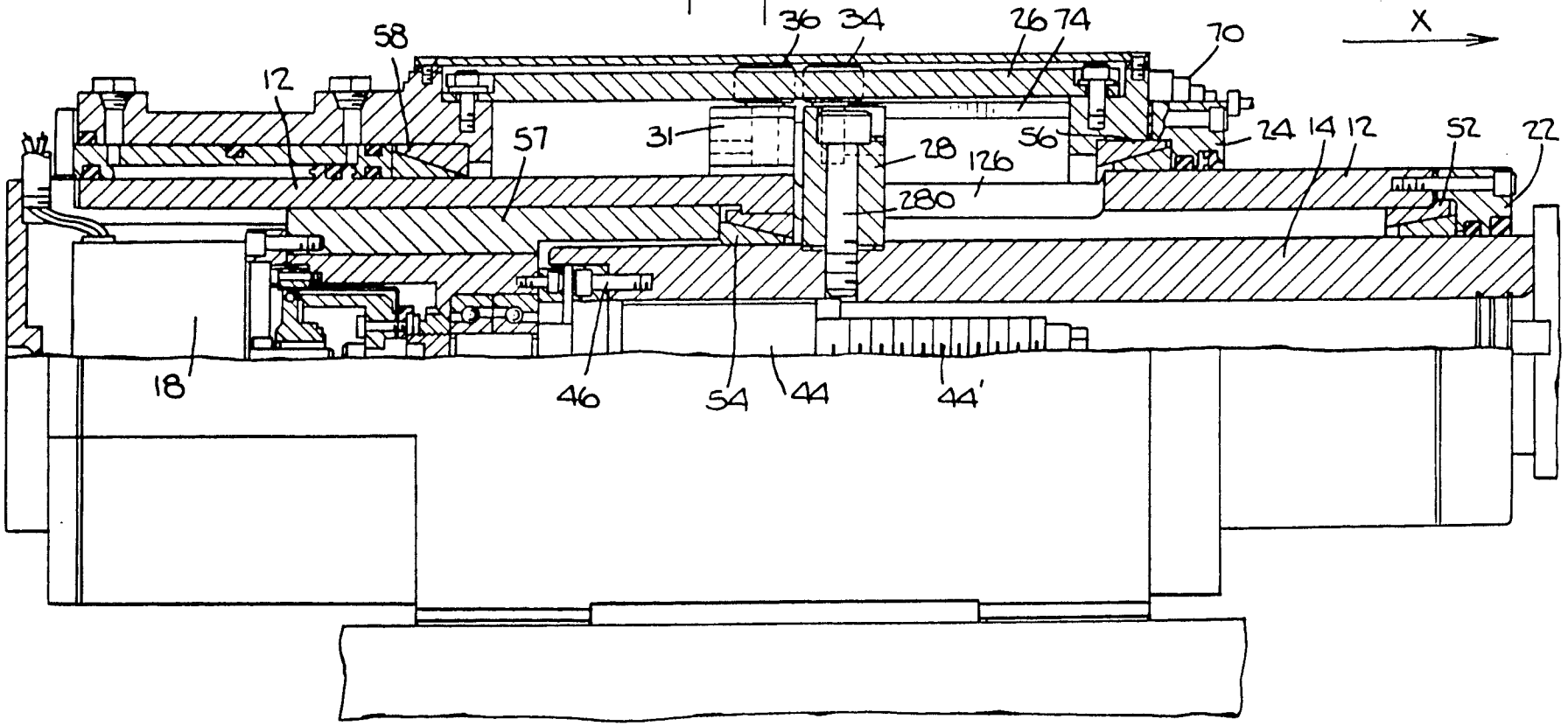
FIG. 4 shows a longitudinal section view of the dressing unit, similar to FIG. 2 except illustrating the outer ram in its extended position.
Figure 5:
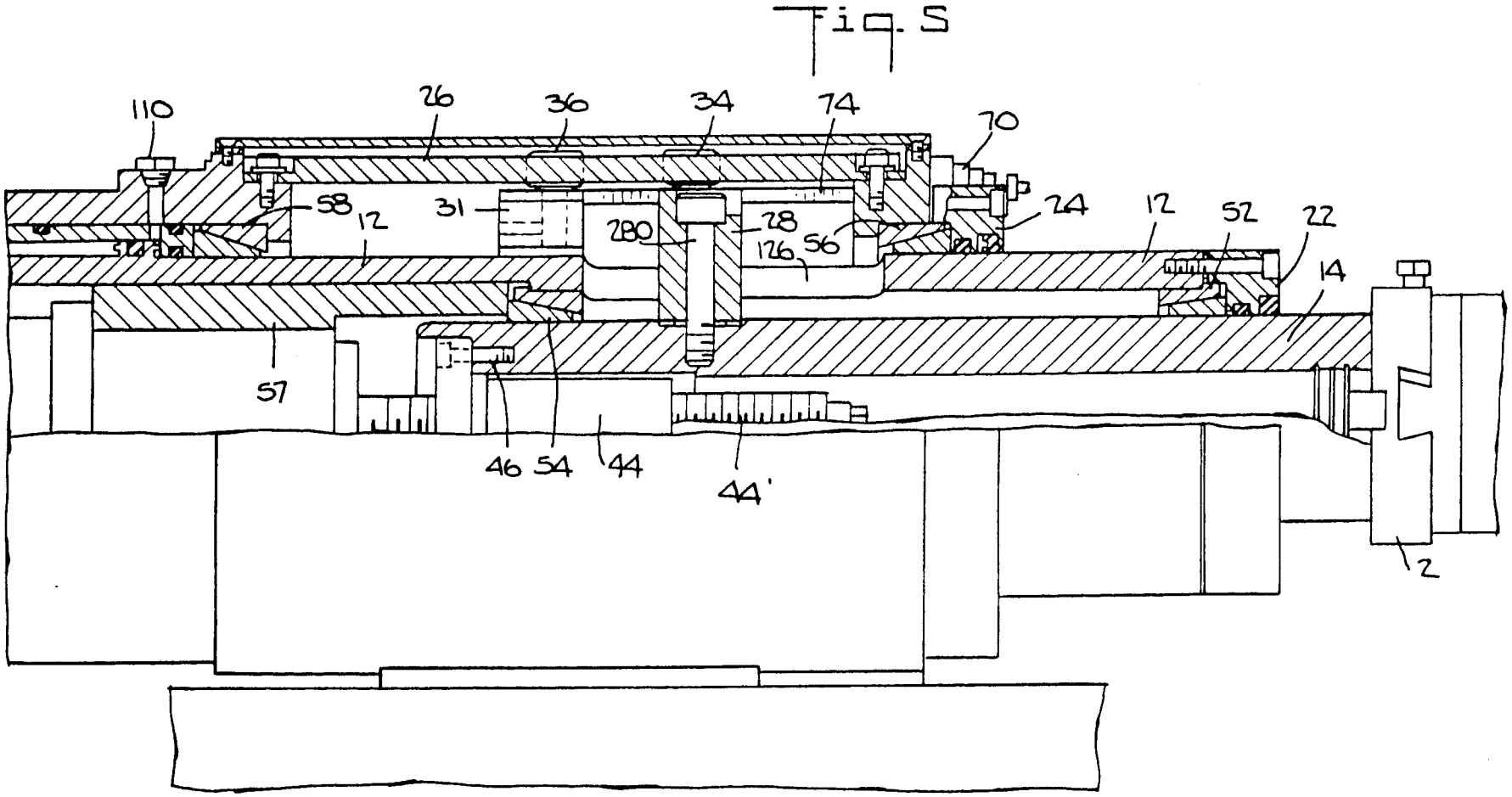
FIG. 5 shows a longitudinal section view of the dressing unit, similar to FIG. 2 except illustrating the outer ram in its extended position and the inner ram in one of its forward positions.

As is apparent, outer ram 12 advances from a rearward retracted position (FIGS. 2 and 6) to a forward extended position (FIGS. 4 and 7). Movement of outer ram 12 simultaneously carries inner ram 14 the same distance. In a preferred embodiment, the outer ram 12 is movable a distance (total stroke) of three inches, designated by distance "a" in FIG. 6.

Inner ram 14, on the other hand, is independently incrementally movable, preferably step-by-step, from an inner position with respect to outer ram 12 (FIGS. 2, 4, 6 and 7) to an extended position (FIGS. 5, 8 and 9). Although only one forward dressing position of inner ram 14 is shown in the drawings (FIG. 8), in actuality, inner ram 14 may occupy a large number of forward dressing positions, as a result of the incremental feed mechanism. In a preferred embodiment, the total stroke of inner ram 14 (the total distance of travel from its innermost position to its forwardmost position) is 2.5 inches. Consequently, in the preferred embodiment outer ram 12 and inner ram 14 can advance a combined total of 5.5 (3+2.5) inches. Obviously, strokes of varying distances can be utilized in accordance with operation of the feeding units of the present invention.

Retraction of inner ram 14 from its forwardmost extended position to its original innermost position is preferably by continuous movement rather than the step-by-step incremental movement associated with its forward motion. As with its forward motion, mounted central block 28 slides rearwardly within slot 126 of outer ram 12 as inner ram 14 is moved inwardly (rearwardly).

In a preferred embodiment, outer ram 12 is moved by an hydraulic piston cylinder and the inner ram 14 is moved by a stepping motor 18 mounted to the rear end of housing 10. Obviously, other methods of imparting axially directed motion to the outer ram 12 and inner ram 14 can be utilized, such as an hydraulic indexer or servo-motor for the inner ram 14.

In operation, hydraulic cylinder 114 is actuated to thrust outer ram 12 forwardly (outwardly) from housing 10 in the direction of arrow X (FIGS. 4 and 7), thereby carrying inner ram 12 the same advanced distance. As elongated rod 74 engages switch 70, advancement of outer ram 12 is halted. Stepping motor 16 generates rotation of ball screw 46, which is reduced via harmonic drive 77 by a ratio of 100 to 1. Rotation of ball screw 46 causes nut 44 to move axially, thereby moving inner ram 12 one step forward for each actuation of motor 16.

Since spindle 3 which has the diamond roll 5 mounted thereon is connected to inner ram 14, the forward stepping of inner ram 14 brings diamond roll 5 into contact with the grinding wheel.

After the advancement of inner ram 14 to its first forward dressing position (FIG. 8) and after the grinding wheel is dressed, outer ram 12 is retracted towards the housing 10 (FIG. 9, arrow Y) by cylinder 114, and its rearward movement is terminated as short rod 76 engages rear switch 72. Rearward movement of outer ram 12 carries the inner ram 14 the identical distance. Subsequently, outer ram 12 is once again advanced by hydraulic cylinder 114 to its extended position, dictated by the positive stop created by elongated rod 74, thereby carrying inner ram 14 forwardly as well. Inner ram 14 is subsequently advanced another step(s) to a second forward dressing position by step motor 16 rotating ball screw 46 to move associated nut 44 forwardly.

After dressing, the outer ram 12 is once again thrust rearwardly to its retracted position (carrying inner ram 14), dictated by the positive stop created by cooperating rod 76 and rear switch 72. This forward and rearward motion of outer ram 12 and inner ram 14 continues until the grinding operation is conducted or the grinding wheel needs replacement. Then outer ram 12 is moved to its rearward position and inner ram 14 is then continuously retracted to its original innermost position to afford space for replacing the wheel.

The present invention has particular advantage in the case of internal grinders, where the grinding wheel used in grinding the work piece moves in a first direction on a wheel slide to enter the work piece, and moves in a second orthogonal direction on a cross slide to engage the interior of a work piece. A customary cycle is to advance the grinding wheel into the work piece, then advance it transversely into contact with the work piece to accomplish grinding. After an appropriate interval, these actions are reversed, retracting the grinding wheel from the work piece. The dressing unit then advances to the proper position, and the grinding wheel is advanced on its cross-slide to engage the dressing roll. When dressing is completed, the dressing unit retracts, and the cycle of grinding and dressing is repeated until the work piece is completed.

The cross-slide may be required to advance the grinding wheel to different transverse positions in relation to the wheel slide axis depending upon the size (e.g. internal diameter) of the particular work piece to be ground. Because of these varying positions of the grinding wheel, there has been a difficulty in providing a dressing unit which accommodates such varying positions. This difficulty is overcome by the present invention. Also, in such internal grinders there is relatively little space allotted for a dressing unit, which the present invention accommodates well.

According to a mode of operation of the present invention particularly adapted for internal grinding, for purposes of set-up, the grinding wheel is retracted from the work piece, and positioned suitably on its cross-slide to a position where it will engage the work piece when the wheel is inserted along the wheel slide to its working position. The outer ram is advanced to its full fixed advance position, carrying the inner ram retracted within it. The inner ram is then advanced to the point where it contacts with the grinding wheel to be dressed. The grinding wheel may then be advanced slightly on its cross-slide to accomplish a first dressing.

At the conclusion of the first dressing operation, the outer ram is retracted to its fixed retracted position, carrying with it the inner ram. This is done preferably by a hydraulic means which rapidly retracts the outer ram carrying the inner ram. The grinding wheel is therefore very quickly released from the dressing unit, and able to be used immediately for its next grinding operation, by moving it to the operative position along the wheel slide.

When the next dressing of the grinding wheel is desired (which may be after each grinding operation, or each partial grinding operation). The grinding wheel is moved along the wheel slide to the dressing position and the dressing unit is again advanced (solely by operation of the outer ram) to its advanced position. Then the grinding wheel will advance along the cross-slide for a minute distance to place it against the dressing roll (now substantially in position to engage the grinding wheel) to accomplish the desired dressing. After this the dressing unit is abruptly retracted to its fixed retracted position (by the outer ram), freeing the grinding wheel for use in the next grinding operation. The procedure is repeated for each following dressing operation.

It will be seen that the dressing operation therefore takes but little time after the first setting up, the dressing tool is advanced by the outer ram to a fixed position at or close to when the grinding wheel is retracted from the work piece, and only a small movement along the cross-slide is needed for dressing. The dressing tool is withdrawn abruptly to the retracted position by the hydraulic means, also requiring a very small time. Hence, the overall grinding plus dressing cycle is speeded up. The present arrangement accommodates very simply to the variations in the normal position of the wheel along its cross-slide, when the size or inner diameter of the work piece is changed.

It will be appreciated that the instant specification and claims are set forth as exemplary illustration and not limitation, and various modifications, additions, or substitutions may be made without departing from the spirit and scope of the present invention.

What is claimed is:

1. A unit for dressing a grinding wheel, comprising:

a rotatable spindle adapted to have a diamond roll fixedly mounted thereon, advancement of the spindle bringing the diamond roll into contact with the grinding wheel for dressing the grinding wheel;

a housing;

a hollow outer ram mounted within said housing;

an inner ram telescopically disposed within said outer ram and connected to said spindle for joint movement therewith;

means for advancing and retracting said outer ram between positive stops;

means independent of said advancing and retracting means for incrementally moving said inner ram with respect to said outer ram from an inner position to an extended position, said inner ram thereby advancing the spindle to bring the diamond roll into contact with the grinding wheel, said outer ram having a slot formed in a central portion, said inner ram having a block mounted thereon which slides within said slot as said inner ram is moved between said inner and extended positions;

a pair of rollers connected to said outer ram to limit vibration of said outer ram; and a mounting block mounted on said outer ram, said rollers being eccentrically mounted on said mounting block.

2. A dressing unit as recited in claim 1 further comprising a track mounted within said housing, said rollers sliding within said track as said outer ram is advanced and retracted.

3. A unit for dressing a grinding wheel with a dressing tool, comprising:

a rotatable spindle on which the dressing tool is adapted to be fixedly mounted for joint rotation therewith; and means for advancing said spindle to bring said dressing tool in contact with the grinding wheel for dressing the same and for retracting said spindle, said advancing and retracting means having:

a housing, a hollow outer ram displaceably mounted within said housing, an inner ram fixedly connected with said spindle and telescopically supported within said outer ram for a joint axial displacement therewith and relative axial displacement with respect thereto, two positive stops located at axially displaced positions along said outer ram and defining, respectively, an advanced position of said outer ram in which said dressing tool is positioned adjacent the grinding wheel, and a retracted position of said outer ram in which said dressing tool is spaced from the grinding wheel a distance enabling changing of the grinding wheel, means associated with said outer ram for advancing and retracting said outer ram, together with said inner ram, between said two positive stops, and means independent of said advancing and retracting means and associated with said inner ram for moving said inner ram with respect to said outer ram from an inner position of said inner ram to an extended position of said inner ram to advance said spindle to thereby bring said dressing tool in contact with the grinding wheel.

4. A dressing unit as recited in claim 3, wherein said positive stops comprise, respectively, first and second actuating members connected to said outer ram at spaced positions therealong and each activating a switching mechanism.

5. A dressing unit as recited in claim 3, wherein said advancing and retracting means comprises a hydraulic cylinder and piston.

6. A dressing unit as recited in claim 3, wherein said inner ram moving means comprises a ball screw powered by an electric stepping motor.

7. A dressing unit as recited in claim 3, wherein said inner ram moving means comprises hydraulic means.

8. A dressing unit as recited in claim 3, further comprising tensioned tapered bearings mounting said outer ram and said inner ram within said housing.

9. A dressing unit as recited in claim 4, further comprising a block mounted on said outer ram, said first and second actuating rods being connected to said block, and respective limit switches cooperating with said rods, said first rod providing a positive stop for advancement of said outer ram and said second rod providing a positive stop for retraction of said outer ram.

10. A dressing unit as recited in claim 3, wherein the spindle is mounted to said inner ram by a U-shaped yoke.

11. A dressing unit as recited in claim 3, wherein said outer ram has a slot formed in a central portion, said inner ram having a block mounted thereon which slides within said slot as said inner ram is moved between said inner and extended positions.

12. A dressing unit as recited in claim 11, further comprising a pair of rollers connected to said outer ram to limit vibration of said outer ram.

13. A dressing unit as recited in claim 3, wherein said inner ram moving means moves said inner ram forwardly step-by-step and rearwardly continuously.

14. An apparatus for dressing a grinding wheel, comprising:

a rotatable spindle adapted to have a diamond roll fixedly mounted thereon for joint rotation therewith;

a yoke for rotatably supporting said spindle; and ram means including a first hollow ram movable between advanced and retracted positions, and a second ram supported within said first ram for joint axial movement therewith between the advanced and retracted positions of said first ram, and for relative axial movement with respect thereto between inner and extended positions, said second ram being connected to said yoke to move said spindle toward the grinding wheel to bring said diamond roll into a positive contact with the grinding wheel.

15. An apparatus as recited in claim 14, further comprising first and second positive stops respectively arranged on opposite axial ends of said first ram for limiting advancement and retraction of said first ram to thereby maintain the range of advancement and retraction of said first ram constant.

16. An apparatus as recited in claim 14, further comprising means for incrementally moving said second ram to the extended position thereof in steps of selectable size.

17. An apparatus as recited in claim 16, wherein said first ram carries said second ram so that advancement and retraction of said first ram causes identical advancement and retraction of said second ram.

18. An apparatus as claimed in claim 17, wherein said first ram comprises a cylinder with a slot, said second ram having a block mounted thereon for sliding within said slot as said second ram moves between said inner and extended positions thereof.

19. An apparatus as claimed in claim 18, further comprising a housing said first and second rams being cylindrical and supported in said housing by tensioned tapered bearings.

20. An apparatus as recited in claim 19, comprising first and second stop actuating rods connected to said outer ram and engageable with first and second switching mechanisms to provide said first and second positive stops.

21. A method of advancing a diamond-roll-mounting spindle into contact with a grinding wheel to dress the grinding wheel, said method comprising the steps of:

providing spindle-advancing means including a first hollow ram and a second ram supported inside the first ram and fixedly connected with the diamond-roll-mounting spindle for joint displacement therewith;

advancing the first ram, together with the second ram, from a retracted position of the first ram to an advanced position the first ram adjacent to the grinding wheel;

advancing the second ram relative to said first ram to position the diamond roll in juxtaposition to the grinding wheel;

advancing the second ram to a first dressing position by an increment corresponding to the desired dressing to the grinding wheel;

returning the first ram to the retracted position thereof;

after further use of said grinding wheel, advancing the first ram to the advanced position thereof; and advancing the second ram by an incremental step to a second dressing position forward of the first dressing position.

22. A method as recited in claim 21, wherein said first ram is always advanced to the same position and retracted to the same position.

23. A method as recited in claim 21, wherein the step of advancing and retracting the first ram comprises the step of hydraulically advancing the first ram.

24. A method as recited in claim 21, wherein the step of advancing said second ram comprises the step of rotating a ball screw by a stepping motor connected to said first ram.

25. A method of dressing a grinding wheel mounted for axial movement and transverse movement with respect to a dressing unit including a first hollow ram having retracted and advanced positions, a second ram mounted within the first ram for movement both therewith and relative thereto, the method comprising the steps:

connecting a dressing tool to the second ram for joint movement therewith;

advancing the first ram, together with the second ram, from the retracted position of the first ram to the advanced position the first ram;

advancing the second ram incrementally relative to the first ram to an extended position of the second ram to move the dressing tool to a position for dressing the grinding wheel;

engaging the dressing tool with said grinding wheel by relative movement between them; and retracting the first ram, together with the second ram, to the retracted position the first ram on completion of dressing, with the second ram remaining in the extended position thereof relative to the first ram.

26. A method as recited in claim 25, further comprising the steps of accomplishing further dressing, the further steps including:

advancing the first ram from the retracted position thereof to the advanced position thereof without subsequently advancing the second ram relative to the first ram, and advancing said grinding wheel into juxtaposition to the dressing tool.

27. A method as recited in claim 25, wherein the method is used for dressing in an internal grinder, and the extended position of the second ram is determined by the transverse position of the grinding wheel with respect to a workpiece, and wherein the step of advancing the second ram is performed in adjustable manner.

28. A dressing unit as recited in claim 6, further comprising a harmonic reduction drive connected to said inner ram moving means.

29. A method as in claim 25 wherein the first ram retracted position and the first ram advanced position are fixed positions.

* * * * *